US011462863B2

(12) United States Patent
Kosmalski et al.

(10) Patent No.: US 11,462,863 B2
(45) Date of Patent: Oct. 4, 2022

(54) PLUG-IN CONNECTOR ELEMENT AND PLUG-IN CONNECTOR FOR HIGH-VOLTAGE APPLICATIONS

(71) Applicant: TE Connectivity Germany GmbH, Bensheim (DE)

(72) Inventors: Christoph Kosmalski, Bensheim (DE); Bernd Leonhardt, Bensheim (DE); Maximilian Veihl, Bensheim (DE); Martin Listing, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/161,037

(22) Filed: Jan. 28, 2021

(65) Prior Publication Data

US 2021/0242636 A1 Aug. 5, 2021

(30) Foreign Application Priority Data

Jan. 31, 2020 (DE) ..... 102020201240.7

(51) Int. Cl.

| | |
|---|---|
| ***H01R 13/66*** | (2006.01) |
| ***H01R 13/05*** | (2006.01) |
| ***H01R 13/53*** | (2006.01) |
| ***H01R 13/64*** | (2006.01) |

(52) U.S. Cl.

CPC ..... *H01R 13/6683* (2013.01); *H01R 13/052* (2013.01); *H01R 13/53* (2013.01); *H01R 13/64* (2013.01)

(58) Field of Classification Search

CPC .. H01R 13/6683; H01R 13/53; H01R 13/052; H01R 13/64

USPC ..... 439/135, 488, 913

See application file for complete search history.

(56) References Cited

U.S. PATENT DOCUMENTS

| | | | | |
|---|---|---|---|---|
| 9,437,972 | B2 * | 9/2016 | Endo | H01R 13/6315 |
| 9,461,405 | B2 * | 10/2016 | Endo | H01R 13/631 |
| 9,570,862 | B2 | 2/2017 | Kawai et al. | |
| 2014/0099818 | A1 | 4/2014 | Endo et al. | |
| 2017/0331233 | A1 * | 11/2017 | AbuGhazaleh | H01F 38/30 |
| 2018/0219316 | A1 * | 8/2018 | Suzuki | H01R 13/6683 |

(Continued)

FOREIGN PATENT DOCUMENTS

| | | | |
|---|---|---|---|
| DE | 102015213674 | A1 | 1/2016 |
| DE | 112014003014 | T5 | 3/2016 |

(Continued)

OTHER PUBLICATIONS

Extended European Search Report in Appln. No. 21152086.1-1201, dated Jun. 7, 2021, 10 pp.

(Continued)

*Primary Examiner* — Gary F Paumen
(74) *Attorney, Agent, or Firm* — Barley Snyder

(57) ABSTRACT

A plug-in connector element includes an electrically conductive contact element, a housing, a contact protection element, and a temperature sensor accommodated at least in part within the contact protection element. The contact protection element is disposed so that, between the housing and the contact protection element, access to the electrically conductive contact element is prevented for an object having a diameter above a defined value. The temperature sensor measures a temperature of the electrically conductive contact element.

20 Claims, 7 Drawing Sheets

(56) References Cited

U.S. PATENT DOCUMENTS

| | | | | |
|---|---|---|---|---|
| 2019/0199040 | A1* | 6/2019 | Tanizaki | H01R 13/629 |
| 2020/0067237 | A1* | 2/2020 | Sarraf | B60L 53/16 |
| 2020/0185847 | A1* | 6/2020 | Feldner | H01R 13/6658 |
| 2020/0290468 | A1 | 9/2020 | Moseke | |
| 2021/0078419 | A1* | 3/2021 | Lyon | G01K 1/14 |
| 2021/0242638 | A1* | 8/2021 | Saito | H01R 13/512 |

FOREIGN PATENT DOCUMENTS

| | | | |
|---|---|---|---|
| DE | 102017212493 | A1 | 8/2018 |
| DE | 102017222808 | A1 | 6/2019 |
| EP | 2720324 | A1 | 4/2014 |
| WO | 02013330 | A1 | 2/2002 |

OTHER PUBLICATIONS

German Office Action, dated Oct. 20, 2020, 12 pages.
Abstract of DE 102015213674, dated Jan. 21, 2016, 1 page.
Abstract of DE 102017212493, dated Aug. 2, 2018, 1 page.

* cited by examiner

PLUG-IN CONNECTOR ELEMENT AND PLUG-IN CONNECTOR FOR HIGH-VOLTAGE APPLICATIONS

CROSS-REFERENCE TO RELATED APPLICATION

This application claims the benefit of the filing date under 35 U.S.C. § 119(a)-(d) of German Patent Application No. 102020201240.7, filed on Jan. 31, 2020.

FIELD OF THE INVENTION

The present invention relates to a plug-in connector and, more particularly, to a plug-in connector element of the plug-in connector for high-voltage (HV) applications.

BACKGROUND

In electromobility, HV plug-in connectors with large conducting cross-sections are needed for propulsion and for charging the HV battery. In order to shorten the charging times, temperature sensors are used in the HV system. In HV plug-in connectors too, temperature sensors are increasingly needed. The more accurate the temperature measurement in the plug-in connector, the better the HV system can adjust the charging parameters, and thus shorten the charging times.

In conventional HV plug-in connectors, it is difficult to position the temperature sensor in the vicinity of the contact point (in the following also referred to as a "hotspot"). Often, there only remains the option of installing the temperature-measurement sensor in the crimping region or at the current rail (remote from the hotspot).

FIGS. 14 to 16 illustrate a known HV plug-in connector arrangement. FIG. 14 shows a schematic sectional view of a plug-in connector 200 in the plugged-in state. The plug-in connector 200 comprises a plug-in connector element 202 and a mating plug-in connector element 204. As shown, the plug-in connector element 202 is a socket element with an electrically conductive spring-loaded contact element 210 and the mating plug-in connector element 204 is a plug-in element with an electrically conductive blade contact 206.

FIG. 15 shows the plug-in connector element 202 in a perspective view. FIG. 16 shows the mating plug-in connector element 204 in a perspective view. In addition, FIGS. 15 and 16 illustrate the functionality of the contact protection in both connecting elements 202, 204, in that test probes 214 (known as test fingers), which are not allowed to touch the electrically conductive parts, are in each case shown schematically.

The electrical contact between the plug-in connector element 202 and the mating plug-in connector element 204 takes place in a contact region 208 in FIG. 14, in which the electrically conductive spring-loaded contact element 210 presses on the blade contact 206. In order to monitor the temperature of the contact region 208, a temperature sensor 212A, 212B should be mounted as close as possible to the contact region 208. In the known arrangement shown, however, due to the spatial conditions, this is possible only in the connecting region of blade contact 206 (temperature sensor 212A) and/or in the crimping region of the socket element (temperature sensor 212B). For this reason, however, the distance to the actual generation zone of a potential temperature increase is too great to be able to react quickly enough to avoid overheating. The consequence is that e.g. batteries have to be charged with lower charging currents over longer times.

SUMMARY

A plug-in connector element includes an electrically conductive contact element, a housing, a contact protection element, and a temperature sensor accommodated at least in part within the contact protection element. The contact protection element is disposed so that, between the housing and the contact protection element, access to the electrically conductive contact element is prevented for an object having a diameter above a defined value. The temperature sensor measures a temperature of the electrically conductive contact element.

BRIEF DESCRIPTION OF THE DRAWINGS

The invention will now be described by way of example with reference to the accompanying Figures, of which:

FIG. 4 is a perspective view of a plug-in connector according to an embodiment before plugging in;

FIG. 5 is a sectional perspective view of the plug-in connector before plugging in;

FIG. 6 is a sectional side view of the plug-in connector after plugging in;

FIG. 7 is a sectional side view of the plug-in connector of FIG. 6 after plugging in;

FIG. 11 is a perspective view of a plug-in connector with the plug-in connector element of FIG. 2 after plugging in;

DETAILED DESCRIPTION OF THE EMBODIMENT(S)

Figure 3:
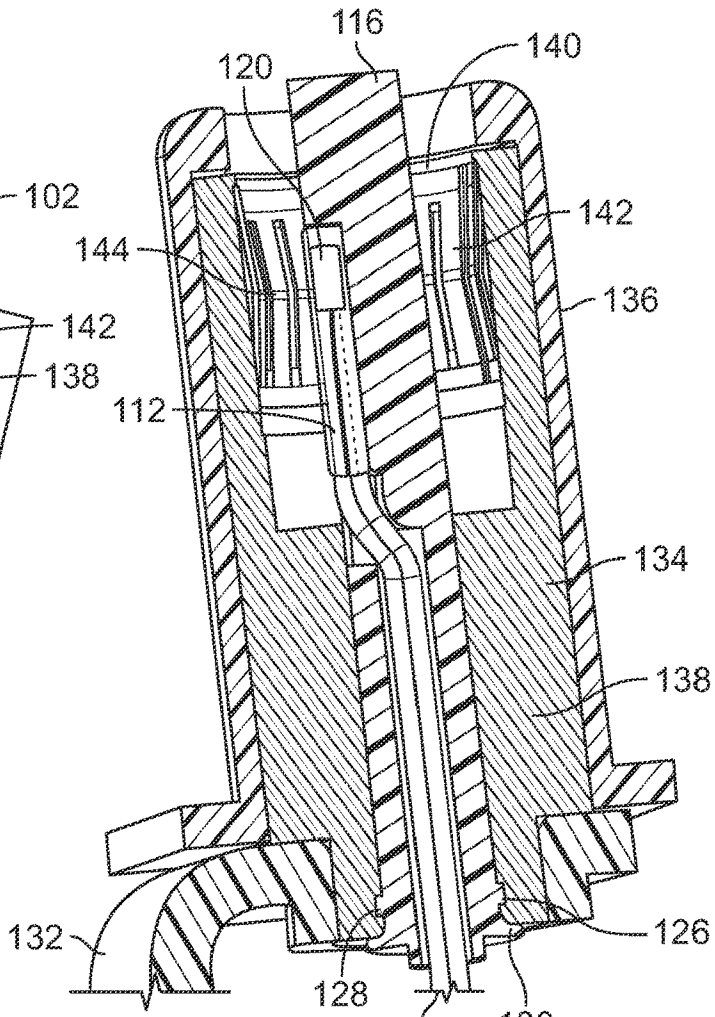
FIG. 3 is a sectional perspective view of the plug-in connector element of FIG. 2.

For better understanding of the present invention, it is elucidated in more detail by the embodiments shown in the following figures. Here, the same parts are given the same reference numerals and the same component designations. Furthermore, some features or feature combinations from the various shown and described embodiments can represent separate independent, innovative, or inventive solutions.

Note that, in all figures, the size relationships and in particular the layer thickness relationships are not necessarily reproduced to scale.

Figure 1:
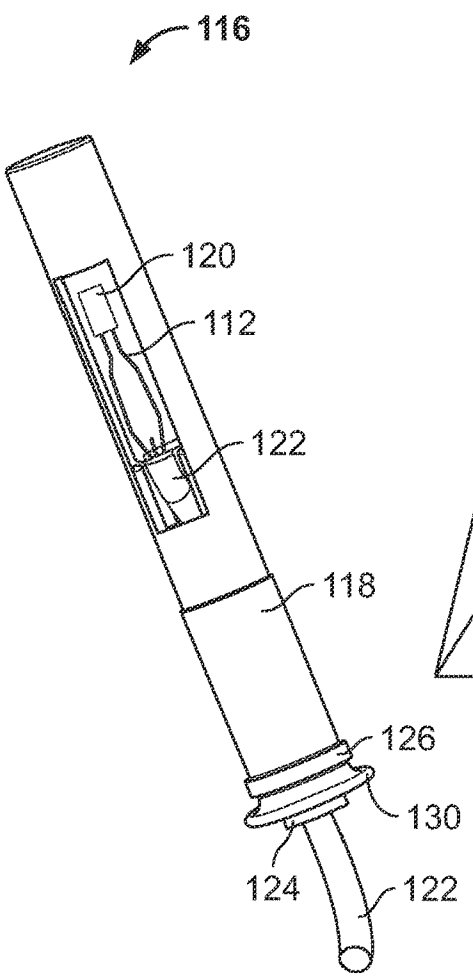
FIG. 1 is a perspective view of a contact protection element according to an embodiment.

A contact protection element 116 according to an embodiment, as shown in FIG. 1, may be used in a high-voltage (HV) round plug (e.g. with a diameter of 12 mm). Other plug-in connector geometries can of course likewise be designed with temperature detection according to the principles of the present invention.

The contact protection element 116, as shown in FIG. 1, has an electrically insulating main body 118 with an elongated, in the assembled state columnar shape. In an embodiment, the main body 118 can be fabricated from a synthetic material.

As shown in FIG. 1, a temperature sensor 112 is embedded in the main body 118 of the contact protection element 116. In an embodiment, the temperature sensor 112 is arranged at an external wall of the contact protection element 116. The temperature sensor 112 can exhibit, for example, a negative temperature coefficient (NTC) thermistor, a thermoelement, a resistance temperature sensor (e.g. Pt), or any other suitable temperature sensor.

An NTC thermistor is a temperature sensor that uses the resistance properties of ceramic-metal composite materials for temperature measurement. NTC sensors offer many advantages for temperature measurement, e.g. small size, durable stability, high accuracy, and precision.

A thermoelement sensor consists of two unequal metals, joined to each other at one end. The temperature is measured at this branching. The two metals generate a small voltage, which can be measured and evaluated by a control system. The unequal metals are insulated individually, and with the help of a jacket, a tight bifilar configuration is maintained. Thermoelement sensors have the advantage of a wide operating temperature range, largely constant sensitivity over their entire range, and availability in suitable miniaturized sizes.

Resistance sensors, known as RTDs (resistance temperature detectors), are sensors that are used for temperature measurement, in that the resistance varies proportionally to the temperature. RTD temperature sensors function even at locations with a harsh or hazardous environment with various official permits.

The temperature sensor 112, as shown in FIG. 1, has a sensitive region 120 that performs the actual temperature detection and an electrical connecting line 122 which connects the temperature sensor 112 with a necessary power supply and measured signal acquisition. In an embodiment, the connecting line 122 is routed through the main body 118 and emerges from the main body 118 at a base region 124. Thereby, the temperature sensor 112 and the connecting line 122 are protected optimally against mechanical stressing.

As shown in FIGS. 1 and 3, the contact protection element 116 has, at the base region 124, a radially surrounding latching ledge 126, which engages with an associated latching groove 128 for fastening the contact protection element 116 in a plug-in connector element. A flange 130 serves in the assembled state for the sealing and mechanical support of the contact protection element 116.

In an embodiment, such a contact protection element 116 fitted with a temperature sensor 112 can be fabricated as a separate part, e.g. through overmolding of the temperature sensor 112, and be held ready for the final assembly. Thereby, the mounting of the temperature sensor 112 in a plug-in connector is significantly simplified.

Figure 2:
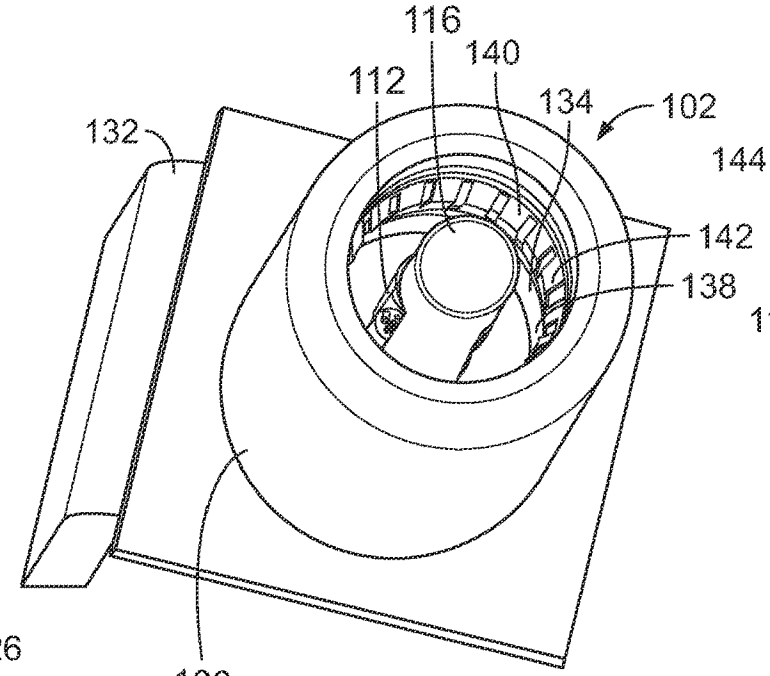
FIG. 2 is a perspective view of a plug-in connector element with the contact protection element of FIG. 1.

FIG. 2 shows in perspective view an HV plug-in connector element 102 that is mounted on a current rail 132. As shown in FIGS. 2 and 3, the contact protection element 116 is so arranged inside an electrically conductive socket contact 134 that access to the electrically conductive parts from outside is impossible for objects that have a larger diameter than a defined test probe. The plug-in connector element 102 comprises an electrically insulating housing 136, which covers the socket contact 134 radially all around and on the front side in an insertion region. The socket contact 134 may also be referred to as an electrically conductive contact element 134.

The socket contact 134 has an electrically conductive contact main body 138, as shown in FIGS. 2 and 3, which establishes an electrical junction to the current rail 132. For electrical contacting of a mating plug-in connector (see FIGS. 5 and 6), the socket contact 134 has a spring contact 140. The spring contact 140, in an embodiment, has a ring-like shape with a large number of bilaterally fastened, radially inward curved flexible tongues 142, which exert a contact pressure on the contact element of the mating plug-in connector. The inward curved region of the flexible tongues 142 forms in the plugged-in state of the plug-in connector the actual electrical contact region 144, in which an undesirable heat build-up first occurs.

In order to detect overheating rapidly, according to a first aspect of the present invention, the temperature sensor 112 is so arranged that a sensitive region 120 of the temperature sensor 112 is located in immediate vicinity to the contact region 144 as shown in FIG. 3.

Figure 6:
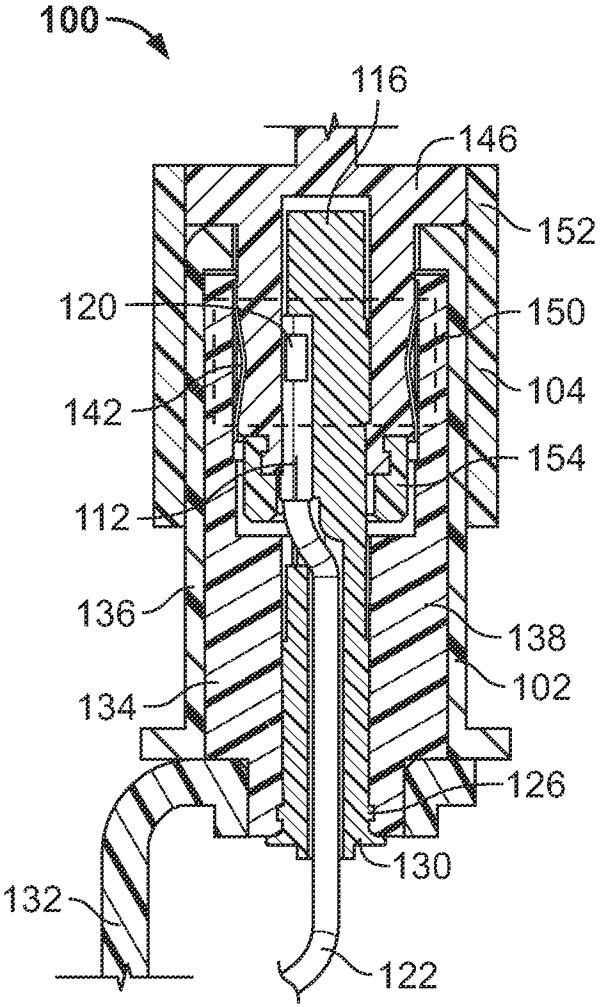
Figure 5:
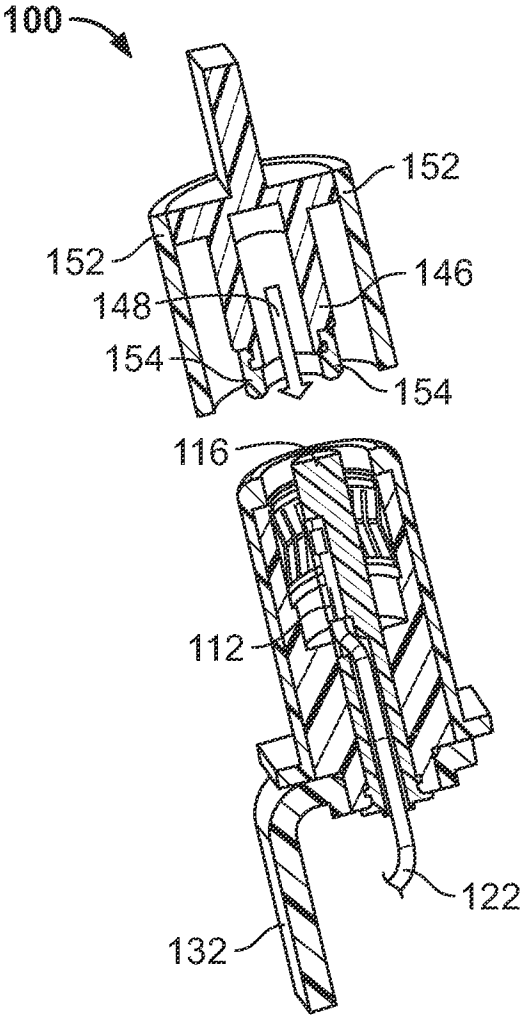
Figure 4:
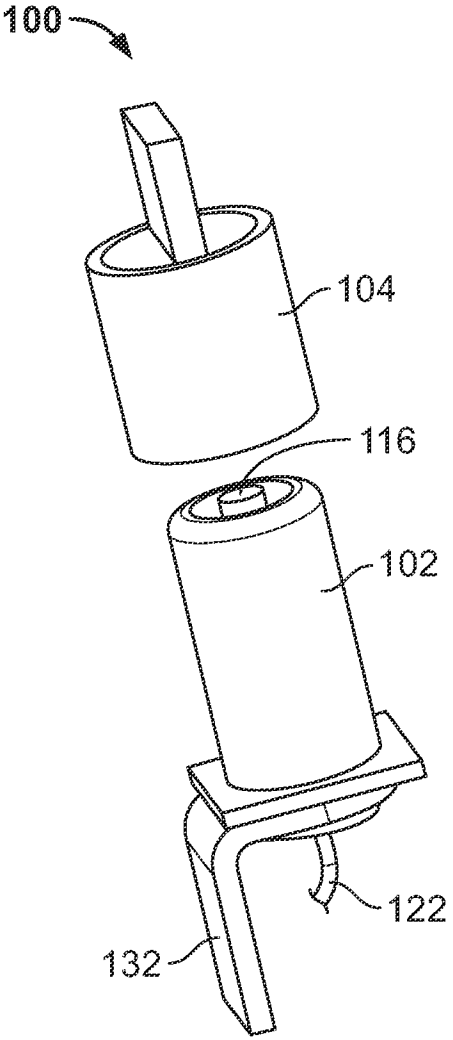

FIGS. 4 to 6 show the plugging together of the plug-in connector element 102 with a mating plug-in connector element 104 to form a plugged-in state of a plug-in connector 100.

According to the shown embodiment, the mating plug-in connector element 104 has a hollow electrically conductive mating contact element 146 with a cylindrical contact region, which when plugging together in the insertion direction 148 grips the contact protection element 116 around and at the same time contacts it electrically from the outside through the spring contact 140. The electrically conductive mating contact element 146 may, at least in part, encompass the contact protection element 116. In an embodiment, the housing 136 has an essentially cylindrical inner surface at which the electrically conductive contact element 134 is disposed. In this way an especially compact construction can be realized. Such a concentric construction has the advantage of an especially compact construction and symmetrical force distribution when plugging in the connector elements.

For electric insulation, the mating plug-in connector 104 has an electrically insulating second housing 152 and an electrically insulating contact protection covering 154, as shown in FIGS. 5 and 6. The contact protection covering 154 is so formed that, between the second housing 152 and the contact protection covering 154, access to the electrically conductive mating contact element 146 is prevented for objects with a diameter above a defined value. In an embodiment, the contact protection covering 154 is formed by an essentially ring-shaped electrically insulating synthetic part, which is arranged on a front-side end region of the electrically conductive mating contact element 146. Such a synthetic part can be manufactured cost-effectively and is either clipped or injection-molded onto a metallic contact element 146.

In an embodiment, the temperature sensor 112 at least in the sensitive region 120 projects slightly from the otherwise smooth outer surface of the contact protection element 116. As shown in FIG. 6, the temperature sensor 112 is pressed in the plugged-in state on an inner surface of the electrically conductive mating contact element 146. Thus, an especially tight thermal contact is ensured and the temperature sensor 112 can respond especially rapidly and reliably to overheating in a critical region 150 marked by a dashed line in FIG. 6.

FIGS. 7 to 10 illustrate how the otherwise unmodified plug-in connector 100 can be modified in its temperature detection functionality by using different variants of the contact protection element 116. FIG. 7 shows again for comparison the plug-in connector 100 of FIG. 6.

Figure 8:
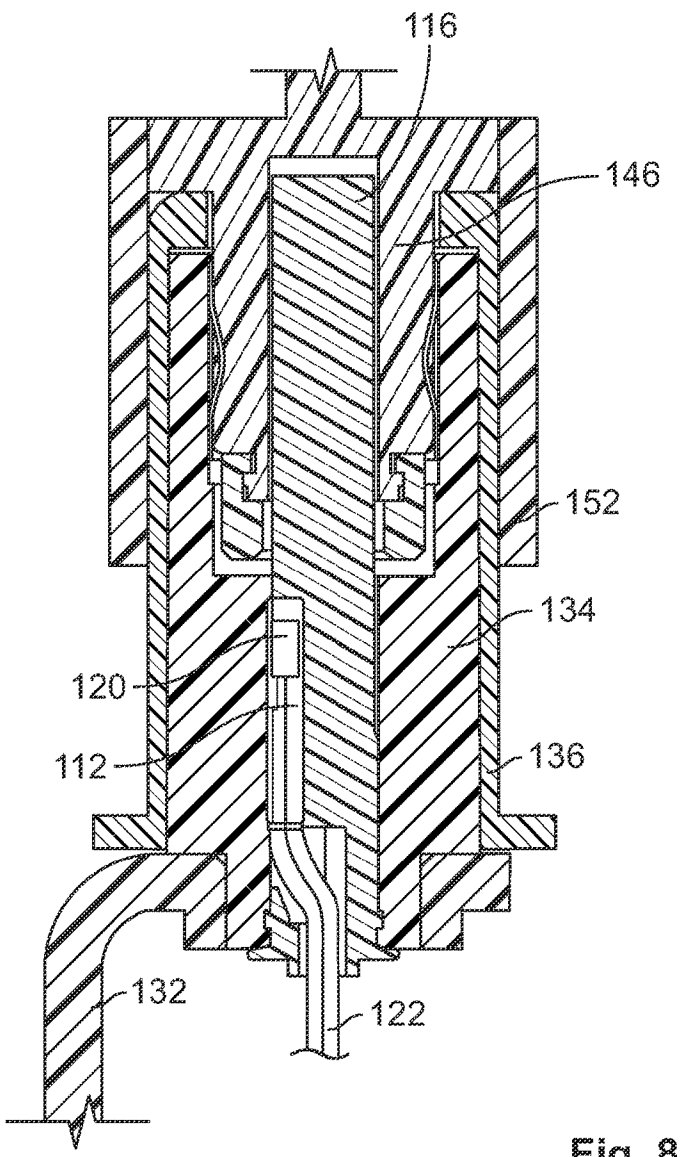
FIG. 8 is a sectional side view of a plug-in connector with a temperature sensor according to another embodiment.

As shown in the embodiment of FIG. 8, the temperature sensor 112 can also be arranged closer at the base region 124 of the contact protection element 116, in order to be able to monitor the temperature in the vicinity of the current rail 132.

Figure 9:
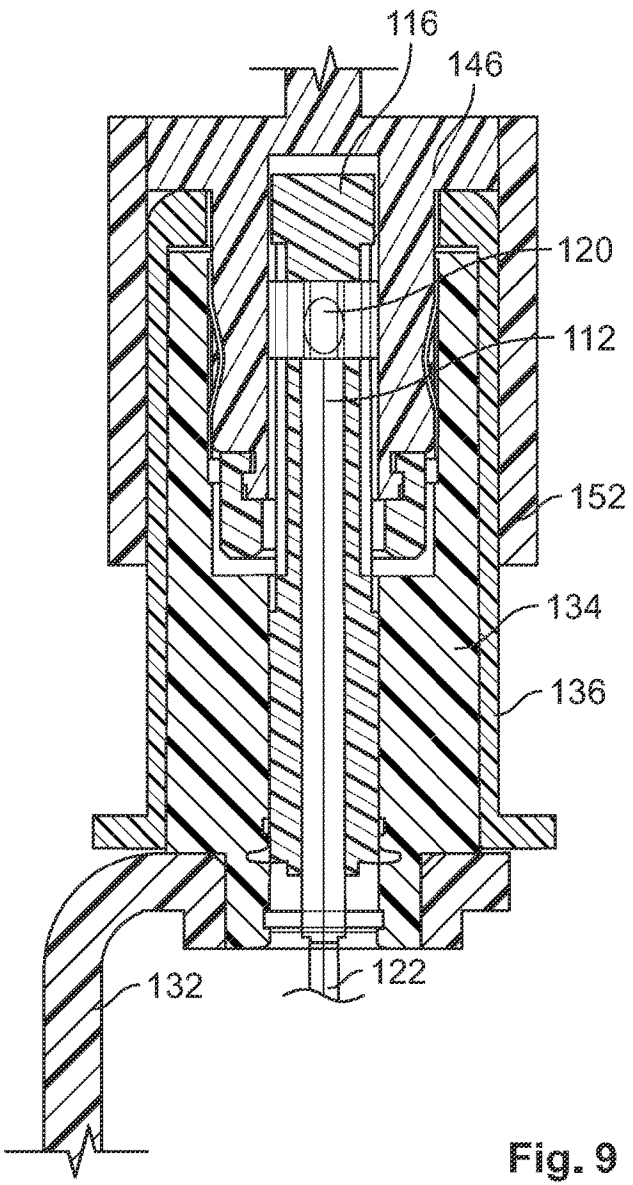
FIG. 9 is a sectional side view of a plug-in connector with a temperature sensor according to another embodiment.

Furthermore, it can also be provided that the temperature sensor 112 is routed centrally through the contact protection element 116, as shown in FIG. 9, in order to make possible, on the one hand, symmetrical temperature detection while, on the other, protecting the temperature sensor 112 mechanically.

Figure 7:
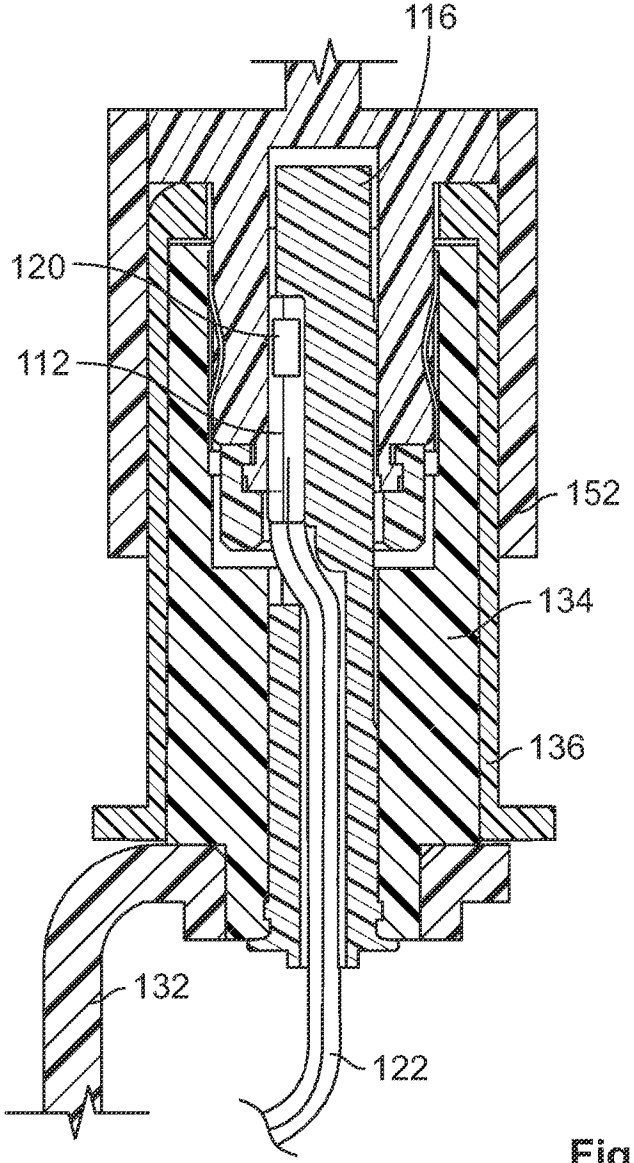
Figure 10:
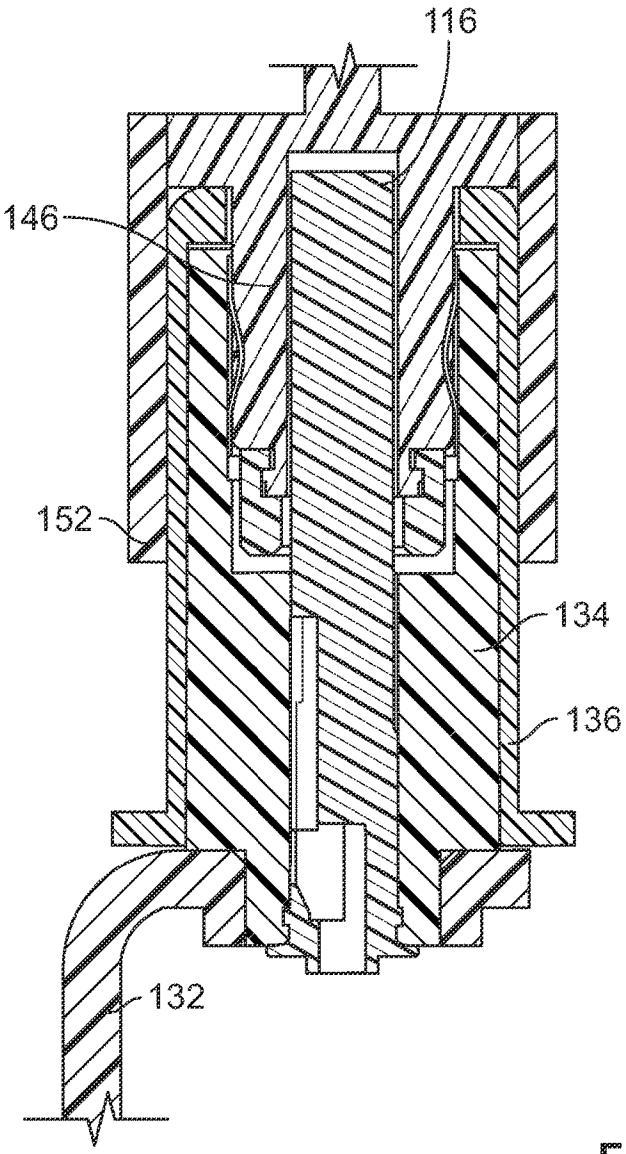
FIG. 10 is a sectional side view of a plug-in connector with a temperature sensor according to another embodiment.

All the variations shown in FIGS. 7 to 9 can also be combined with each other, by using more than only one temperature sensor 112 or a sensor with more than one sensitive region 120. Each of the shown contact protection elements 116, as shown in the embodiment of FIG. 10, can also be used simply without the temperature sensor 112.

Figure 11:
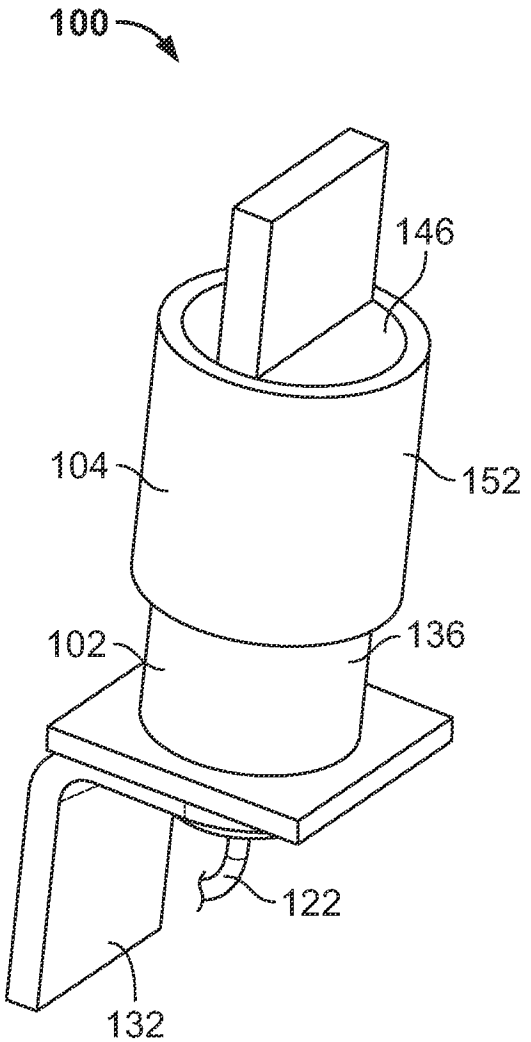
Figure 12:
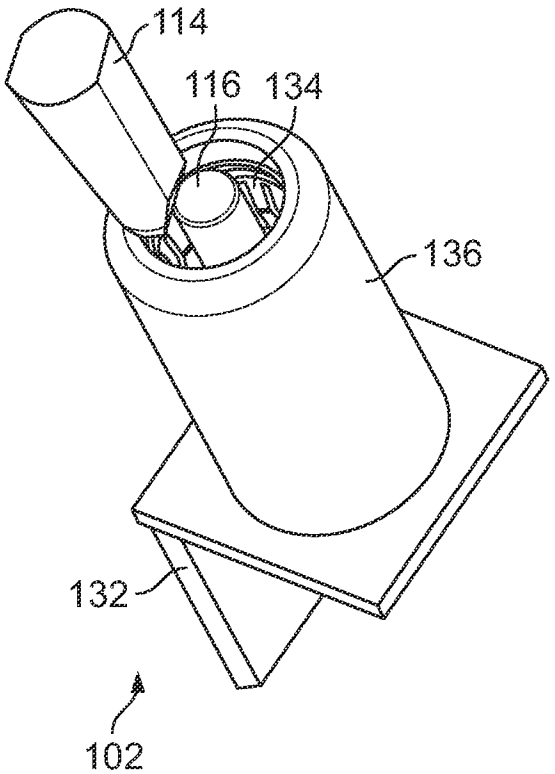
FIG. 12 is a perspective view of the plug-in connector of FIG. 2 with a test probe.
Figure 13:
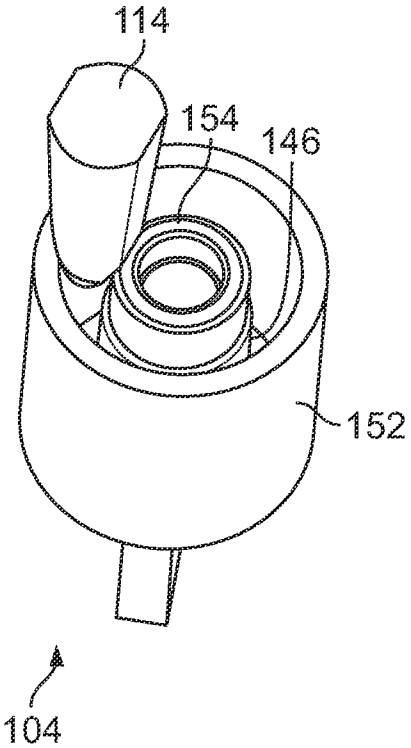
FIG. 13 is a perspective view of a mating plug-in connector of FIG. 4 with a test probe.
Figure 14:
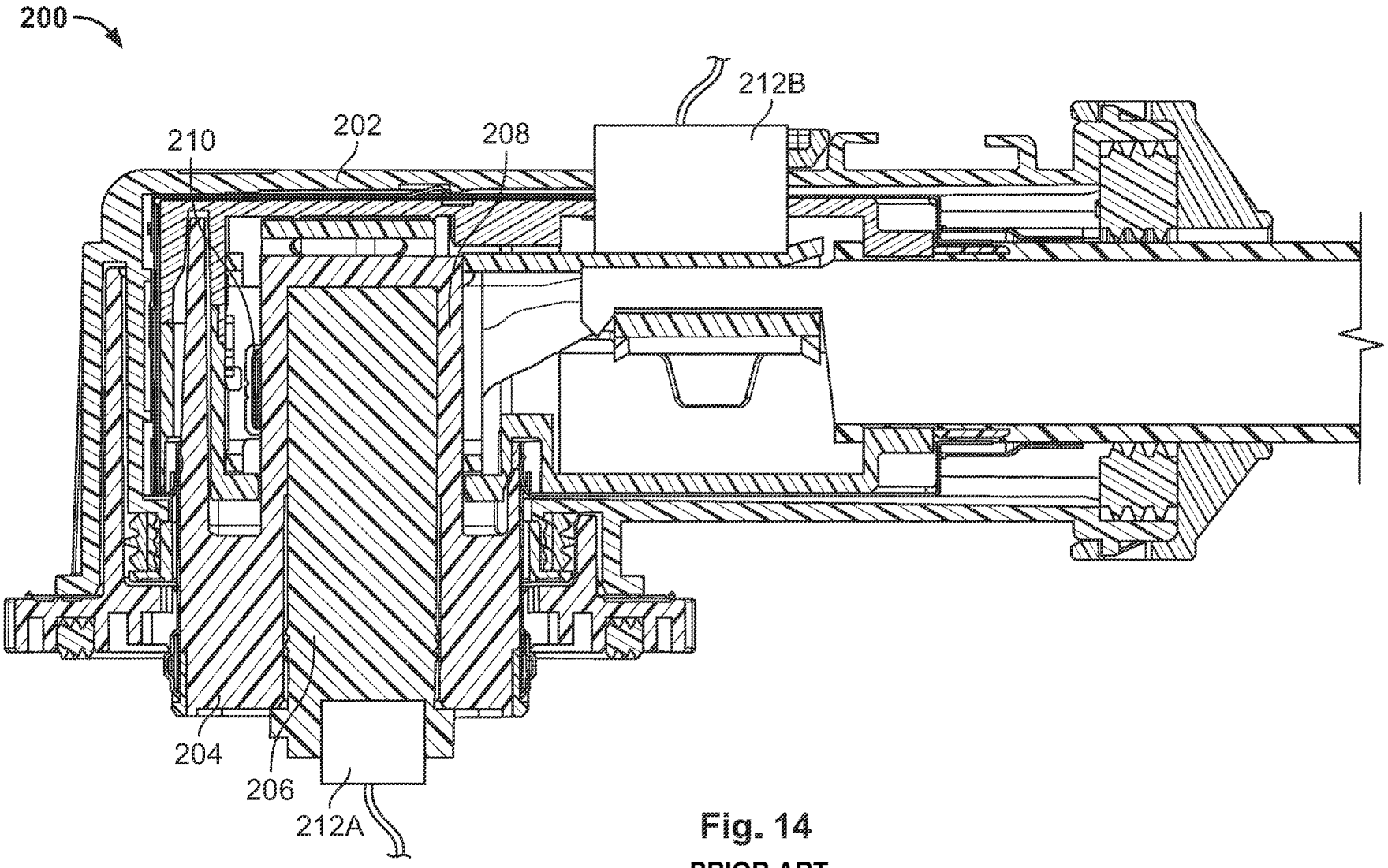
Fig. 14 PRIOR ART
FIG. 14 is a sectional side view of a known HV plug-in connector.
Figure 16:
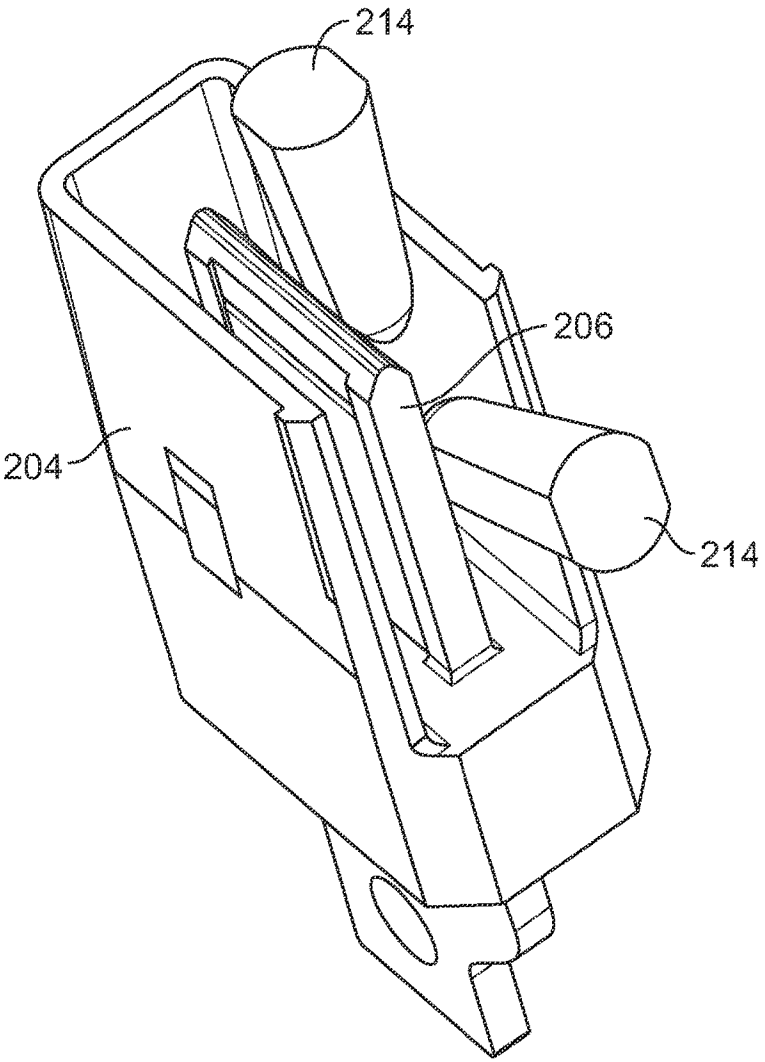
Fig. 16 PRIOR ART
FIG. 16 is a perspective view of a mating plug-in connector element of the plug-in connector of FIG. 14 with a test probe.
Figure 15:
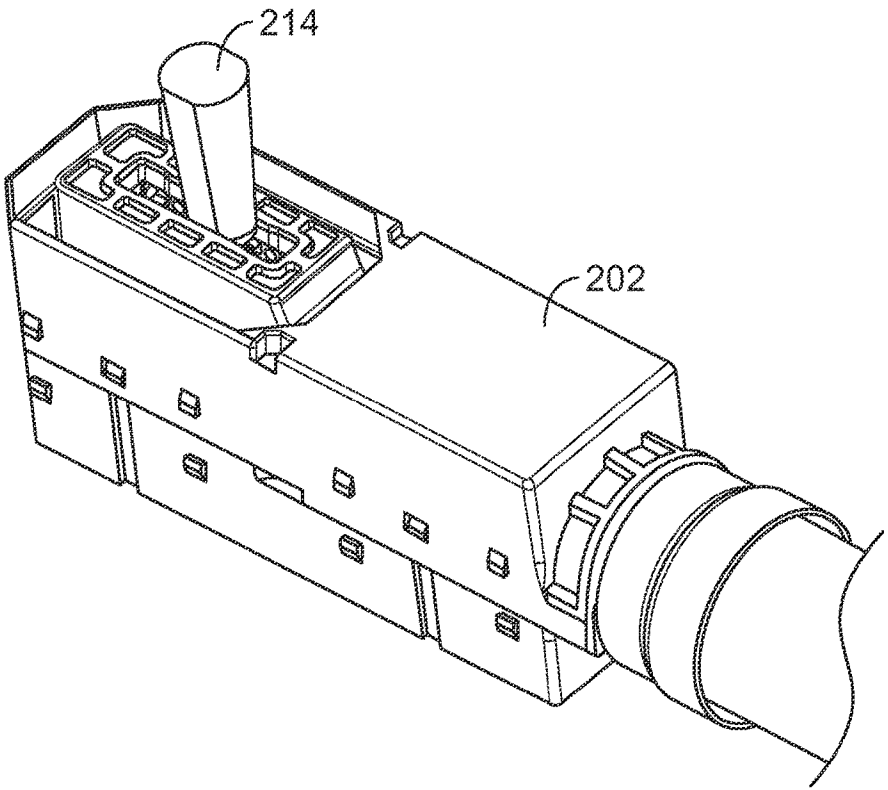
Fig. 15 PRIOR ART
FIG. 15 is a perspective view of a plug-in connector element of the plug-in connector of FIG. 14 with a test probe.

FIG. 11 shows the plug-in connector 100 in the plugged-in state. In FIG. 12, the contact protection functionality of the plug-in connector element 102 is illustrated. As shown, a test probe 114 cannot penetrate into the free space between the contact protection element 116 and the housing 136 and touch the conductive parts, i.e. the socket contact 134. Likewise, as shown in FIG. 13, the interaction of the second housing 152 with the contact protection covering 154 prevents the test probe 114 (and for this reason all objects that have a larger diameter than the test probe 114) touching the electrically conductive mating contact element 146. In the plug-in connector element 102, the enclosed plug-in connections are safe and reliable in operation, but nevertheless can be fabricated cost-effectively.

In summary, according to an exemplary aspect of the present invention, it is made possible through a new arrangement of the contact parts e.g. with a 12 mm round contact with the finger protection, to situate the temperature sensor 112 installation-space-neutrally and flexibly even in the immediate vicinity of the hotspot. The sensor 112 is arranged in the contact protection element 116 at the optimal position as regards contact layout. The necessary contact pressure of the sensor 112 on the measurement surface is generated, depending on the mounting position, either by the plugging-in process or when assembling the contact protection. The connecting line 122 of the sensor 112 can also be reliably installed and routed away in the contact protection element 116. With this solution, the temperature measurement in the HV plug-in connector 100 becomes more accurate and more flexible.

It should further be noted that, although in the above description as an example always a round contact is described, nevertheless other contact cross-sections and also multiple contacts can of course likewise be designed according to the principles of the present invention. In other embodiments, not only one single temperature sensor 112 but also a large number of temperature sensors 112 can be arranged in and/or at the contact protection element 116. Furthermore, temperature sensors 112 with more than only one sensitive region can also be deployed.

The advantageous properties of the plug-in connector 100 come into effect when the plug-in connector 100 is implemented as a high-voltage plug-in connector for an electric vehicle. The plug-in connector 100, however, is also usable and effective in other applications.

What is claimed is:

1. A plug-in connector element, comprising:

an electrically conductive contact element;

a housing;

a contact protection element disposed so that, between the housing and the contact protection element, access to the electrically conductive contact element is prevented for an object having a diameter above a defined value, the contact protection element is an electrically insulating part arranged within the electrically conductive contact element; and a temperature sensor accommodated at least in part within the contact protection element and measuring a temperature of the electrically conductive contact element.

2. The plug-in connector element of claim 1, wherein the temperature sensor detects the temperature of the electrically conductive contact element in a contact region in which the electrically conductive contact element is electrically contactable with an electrically conductive mating contact element of a mating plug-in connector element.

3. The plug-in connector element of claim 1, wherein the housing has a cylindrical inner surface at which the electrically conductive contact element is disposed.

4. The plug-in connector element of claim 3, wherein the electrically conductive contact element encompasses the contact protection element at least in part.

5. The plug-in connector element of claim 1, wherein the contact protection element has a columnar structure.

6. The plug-in connector element of claim 1, wherein the temperature sensor is arranged at an external wall of the contact protection element.

7. The plug-in connector element of claim 1, wherein the temperature sensor is arranged on an inside of the contact protection element.

8. The plug-in connector element of claim 1, wherein the electrically conductive contact element includes a cylindrical main body and a spring contact for spring-loaded contacting of an electrically conductive mating contact element.

9. The plug-in connector element of claim 8, wherein the spring contact has a ring-like and a plurality of bilaterally fastened flexible tongues.

10. The plug-in connector element of claim 9, wherein each of the bilaterally fastened flexible tongues are bent radially inward in order to contact the electrically conductive mating contact element.

11. The plug-in connector element of claim 1, wherein the temperature sensor has an electrical connecting line routed through the contact protection element.

12. A plug-in connector, comprising:

a plug-in connector element including an electrically conductive contact element, a housing, a contact protection element disposed so that, between the housing and the contact protection element, access to the electrically conductive contact element is prevented for an object having a diameter above a defined value, and a temperature sensor accommodated at least in part within the contact protection element and measuring a temperature of the electrically conductive contact element; and a mating plug-in connector element matable with the plug-in connector element, the mating plug-in connector having an electrically conductive mating contact element with a cylindrical contact region, wherein, in a plugged-in state of the plug-in connector element with the mating plug-in connector element, the cylindrical contact region of the electrically conductive mating contact element encompasses the contact protection element.

13. The plug-in connector of claim 12, wherein the temperature sensor is pressed onto the electrically conductive mating contact element in the plugged-in state.

14. The plug-in connector of claim 12, wherein the mating plug-in connector element includes a second housing and a contact protection covering.

15. The plug-in connector of claim 14, wherein the contact protection covering is disposed so that, between the second housing and the contact protection covering, access to the electrically conductive mating contact element is prevented for the object having the diameter above the defined value.

16. The plug-in connector of claim 15, wherein the contact protection covering is formed by a ring-shaped electrically insulating synthetic part arranged on a front-side end region of the electrically conductive mating contact element.

17. The plug-in connector of claim 12, wherein the plug-in connector is a high-voltage plug-in connector for an electric vehicle.

18. The plug-in connector of claim 12, wherein the temperature sensor is arranged on an inside of the contact protection element.

19. The plug-in connector of claim 12, wherein the contact protection element is an electrically insulating part arranged within the electrically conductive contact element.

20. A plug-in connector element, comprising:

an electrically conductive contact element;

a housing;

a contact protection element disposed so that, between the housing and the contact protection element, access to the electrically conductive contact element is prevented for an object having a diameter above a defined value; and a temperature sensor accommodated inside of the contact protection element and measuring a temperature of the electrically conductive contact element.

* * * * *